US007405695B2

(12) United States Patent
Liu

(10) Patent No.: US 7,405,695 B2
(45) Date of Patent: Jul. 29, 2008

(54) SWITCHING CIRCUIT AND CONTROL METHOD OF ANTENNA MODULE

(75) Inventor: I-Ru Liu, Taipei (TW)

(73) Assignee: Accton Technology Corporation, Hsinchu (TW)

( * ) Notice: Subject to any disclaimer, the term of this patent is extended or adjusted under 35 U.S.C. 154(b) by 54 days.

(21) Appl. No.: 11/235,222

(22) Filed: Sep. 27, 2005

(65) Prior Publication Data

US 2007/0069948 A1 Mar. 29, 2007

(51) Int. Cl.
*H01Q 3/24* (2006.01)

(52) U.S. Cl. ..... 342/374

(58) Field of Classification Search ..... 342/374
See application file for complete search history.

(56) References Cited

U.S. PATENT DOCUMENTS 3,680,113 A * 7/1972 Dorier et al. ..... 342/374
4,123,759 A * 10/1978 Hines et al. ..... 342/374
5,257,031 A * 10/1993 Scarpetta et al. ..... 342/374
5,355,139 A * 10/1994 Hirata et al. ..... 342/371
5,745,077 A * 4/1998 Das ..... 342/374
5,943,011 A * 8/1999 Acoraci et al. ..... 342/373
6,266,010 B1 * 7/2001 Ammar et al. ..... 342/374
6,710,742 B1 * 3/2004 Meredith ..... 342/373
6,741,208 B1 * 5/2004 West et al. ..... 342/374
6,850,189 B2 * 2/2005 Ilg et al. ..... 342/374
7,071,873 B2 * 7/2006 Tomasic et al. ..... 342/372

* cited by examiner

*Primary Examiner*—Gregory C Issing
(74) *Attorney, Agent, or Firm*—Rosenberg, Klein & Lee

(57) ABSTRACT

A switching circuit is used for switching a plurality of antennas of an antenna module so that the antenna module has a plurality of modes of use. Each mode of use uses two antennas for radiating a transmitting signal generating by a signal processing unit or sending a received signal to the signal processing unit. The switching circuit includes a plurality of power dividing modules, a plurality of switches and a control unit for controlling on/off of the switches. A mode of use is selected so as to pass the signal, through the switches and the power dividing modules, to the antennas for being radiated. The signal received by the antennas is transmitted to the signal processing unit also through the power dividing modules and switches. The control method determines the mode of use of the antenna module. At first, select a mode of use of the antenna module and switch to the selected mode. Next monitor signal throughput of the switched mode. Then compare the throughput value with a threshold value. If the throughput value is lower than the threshold value, another mode of use is selected.

7 Claims, 4 Drawing Sheets

| fourth switch | third switch | second switch | first switch | modes |
|---|---|---|---|---|
| Don't care | Don't care | 1 | 1 | first antenna<br>second antenna |
| Don't care | Don't care | 2 | 1 | third antenna<br>fourth antenna |
| 1 | 1 | Don't care | 2 | first antenna<br>third antenna |
| 2 | 1 | Don't care | 2 | first antenna<br>fourth antenna |
| 1 | 2 | Don't care | 2 | second antenna<br>third antenna |
| 2 | 2 | Don't care | 2 | second antenna<br>fourth antenna |

Fig. 2

SWITCHING CIRCUIT AND CONTROL METHOD OF ANTENNA MODULE

BACKGROUND OF THE INVENTION

The present invention relates to an antenna module, especially to a switching circuit and a control method of the antenna module that improves efficiency of the antenna module.

Due to fast development of wireless technology, the function of wireless devices are dramatically improved so that people's lives are more convenient. For example, wireless network devices avoid the problem of general network devices that are restricted by wires. Without antennas, wireless network devices such as access points or client stations can't transmit or receive information. Therefore, antennas play a key role in wireless network devices.

Nowadays the antenna module is disposed with a switching circuit for switching a plurality of antennas arranged thereof and thus providing various modes of use of wireless network devices. The switching circuit includes a plurality of switches coupled between a signal processing unit and antennas. A transmitting signal generated by the signal processing unit passes the switches and then sends to the antenna for transmission. A signal received by the antenna also passes through the switches and arrives at the signal processing unit for reception. A control unit controls on/off of the switches. Thus through the control unit, the antenna of the antenna module intended to use is selected.

However, while switching the antenna of the antenna module, conventional switching circuit can only switch to one antenna so that there are limited modes of use for antenna module. For example, there is an antenna module with four antennas, only four modes of use are provided. Moreover, due to limited gain of each antenna, if only one antenna is used, the maximum effective isotropic radiated power and receive sensitivity are restricted. Thus the performance of wireless network devices is also affected.

Therefore there is a need to provide a switching circuit and a control method of an antenna module with a plurality of modes of use so as to increase gain of the mode for improving efficiency of the antenna module and further enhancing performance of the embedded wireless network devices.

SUMMARY OF THE INVENTION

It is a primary object of the present invention to provide a switching circuit of an antenna module that makes the antenna module have a plurality of use modes. Each mode uses two antennas to form beam so that the gains of antennas are added. Thus the efficiency of the antenna module is increased.

It is another object of the present invention to provide a control method of an antenna module that selects proper use mode of the antenna module so as to improve the efficiency of the antenna module.

The switching circuit of the antenna module according to the present invention includes a plurality of power dividing modules for dividing a transmitting signal generated from a signal processing unit into the antennas of the antenna module; a plurality of switches, each coupled to the signal processing unit and power dividing modules. Thus the transmitting signal generated from the signal processing unit is passed to the power dividing modules by the switches and further divided to the antennas; furthermore, a receiving signal received by the antennas is also passed to a signal processing unit through the power dividing modules as well as switches for being processed; a control unit for controlling on/off of the switches—that means controlling of a plurality of antennas of the antenna module. Thus the antenna module has a plurality of modes of use and each mode has two antennas for radiating a signal sent from the signal processing unit or receiving a signal sent to the signal processing unit.

The control method of the antenna module according to the present invention determines a use mode of the antenna module. First, choose a mode of use of the antenna module and switch to the selected mode. Then, monitor a throughput value of the signal of the switched mode. At last, compare the throughput value with a threshold value. When the throughput value is higher than or equal to the threshold value, continue to use the selected mode and monitor the throughput value. When the throughput value is lower than the threshold value, another mode is selected.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein

FIG. 2 is a list showing various modes of use of an embodiment in accordance with the present invention;

DETAILED DESCRIPTION OF THE PREFERRED EMBODIMENT

Figure 1:
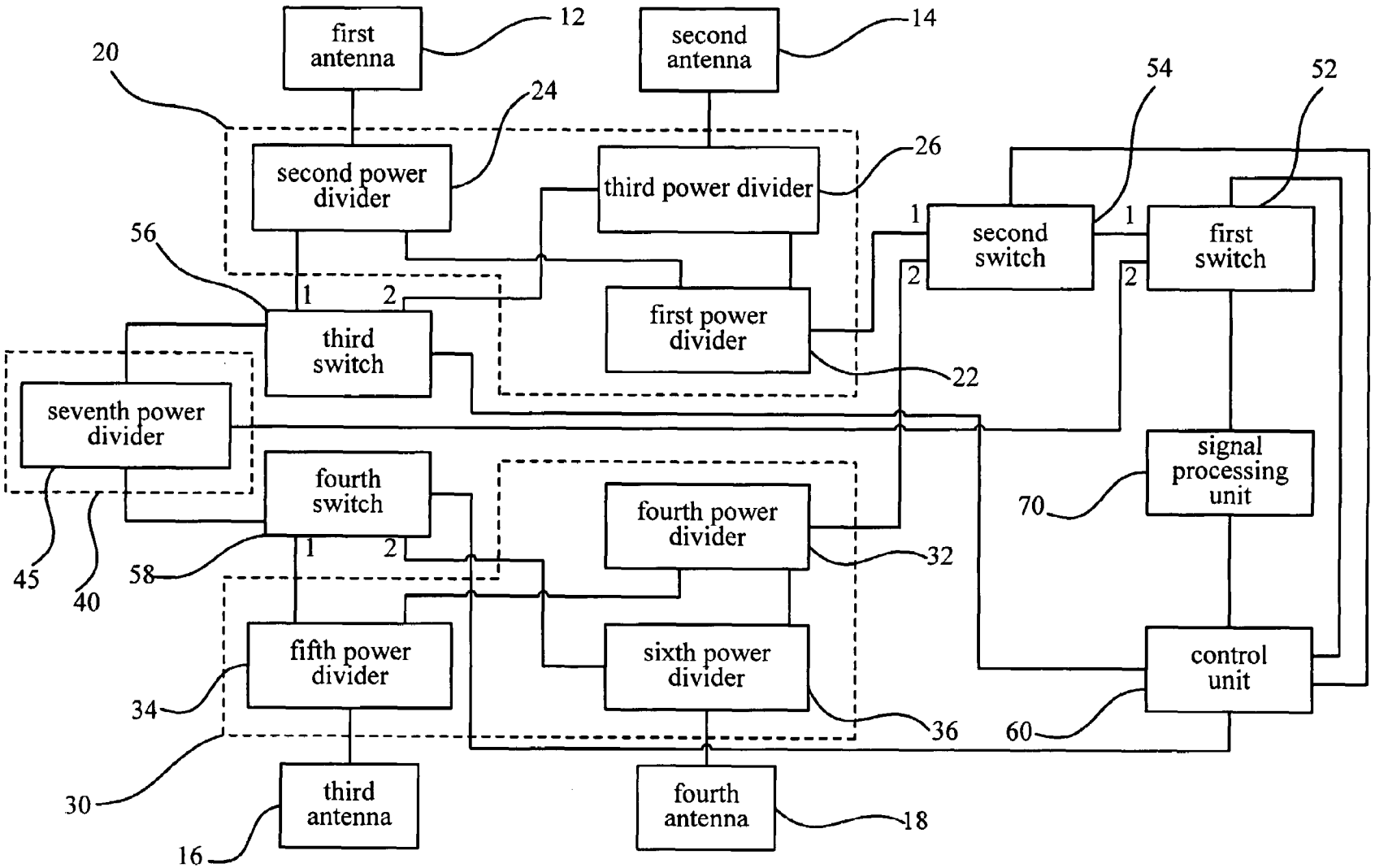
FIG. 1 is a block diagram of an embodiment in accordance with the present invention.

Refer to FIG. 1, a switching circuit of the present invention is applied to an antenna module having a plurality of antennas. The plurality of antennas consists of a first antenna 12, a second antenna 14, a third antenna 16, and a fourth antenna 18. The antenna module is disposed on wireless network devices, such as access points, bridges, gateways, switches, client stations, server stations and other types of stations. The first antenna 12 and the second antenna 14 are arranged on one side of the wireless network device while the third antenna 16, and the fourth antenna 18 are installed on the other side of the wireless network device. The polarization difference (co- or cross-polarized), squint angle (0° or 180°) and the spacing (less than a half of wavelength, less than the wavelength, or greater than the wavelength) between each antenna pair can be adjusted for array-gain only maximizing, diversity-gain only maximizing, or the trade-off of above two gains.

The switching circuit is composed by a plurality of power dividing modules, a plurality of switches and a control unit 60. The switches are connected to a signal processing unit 70 and the power dividing modules. A transmitting signal generated from the signal processing unit 70 passes through switches and sends to the power dividing modules for being dividing into antennas and radiated. A receiving signal received by antennas also passes through the power dividing modules and switches, and then reaches the signal processing unit 70 for being processed. The on/off of the switches are controlled by the control unit 60. The signal processing unit 70 is also under control of the control unit 60. The signal processing unit 70 includes a transmit/receive switch, a low noise amplifier, a transceiver and a base-band process/medium access control.

A plurality of power dividing modules in accordance with the present invention includes a first power dividing module 20, a second power dividing module 30, and a third power dividing module 40. And the switches consists of a first switch 52, a second switch 54, a third switch 56, and a fourth switch 58. Each switch 52, 54, 56, 58 is coupled with the control unit 60 so that the on/off of the switches 52, 54, 56, 58 are controlled by the control unit 60. The first switch 52 is coupled between the signal processing unit 70 and the third power dividing module 40. The second switch 54 is arranged between the first switch 52 and the first power dividing module 20 as well as between the first switch 52 and the second power dividing module 30. The third switch 56 is set between the third power dividing module 40 and the first power dividing module 20 while the fourth switch 58 is between the third power dividing module 40 and the second power dividing module 30. The above switches are non-reflective Single Pole Double Throw switches so as to decrease the miss-match loss.

The first power dividing module 20 includes a first power divider 22, a second power divider 24, and a third power divider 26. The first power divider 22 is coupled to the second switch 54, the second power divider 24 as well as the third power divider 26. The second power divider 24 and the third power divider 26 are coupled to the first antenna 12 and the second antenna 14 respectively. Both the second power divider 24 and the third power divider 26 are coupled to the third switch 56. The second power dividing module 30 is composed by a fourth power divider 32, a fifth power divider 34, and a sixth power divider 36.

The fourth power divider 32 is coupled to the second switch 54, the fifth power divider 34 and the sixth power divider 36. The fifth power divider 34 and the sixth power divider 36 are coupled to the third antenna 16 and the fourth antenna 18 respectively. Both the fifth power divider 34 and the sixth power divider 36 are coupled to the fourth switch 58. The third power dividing module 40 includes a seventh power divider 45 that is coupled to the first switch 52, the third switch 56 and the fourth switch 58 respectively. In order not to limit the bandwidth of coupling, the power dividers for coupling power can be T-junction splitter, inline splitter, Wilkinson splitter, branch line coupler, directional coupler, 90-degrees hybrid coupler or magic-Tee coupler. Moreover, in order to decrease the insertion loss, each power divider is disposed with transformer, phase shifter/attenuator or impedance matching circuit.

Refer to FIG. 2, through on/off of the switches 52, 54, 56, 58 controlled by the control unit 60, the antenna module of the present invention has three patterns. Each pattern has two modes of use. The first pattern is a formed-beam switching pattern that the first antenna 12 and the second antenna 14 located on front side of the antenna module are used or the third antenna 16 and the fourth antenna 18 located on rear side of the antenna module are used.

The mode of use of the first pattern is that the first switch 52 is switched to the circuit 1 in FIG. 1 by the control unit 60 according to the list in FIG. 2. The first switch 52 and the second switch 54 are turned on with each other while the second switch 54 is switched to the circuit 1 in FIG. 1 so as to make the second switch 54 electrically connect with the first power divider 22. Because the first switch 52 is switched to the circuit 1 in FIG. 1, there is no need to care the third switch 56 and the fourth switch 58. Thus the first antenna 12 and the second antenna 14 in front of the antenna module can be used. In the same way, if user intends to switch to the second mode of use of the first pattern-use the third antenna 16 and the fourth antenna 18 on rear end of the antenna module, switch the first switch 52 to the circuit 1 in FIG. 1 while the second switch 54 is switched to the circuit 2 in FIG. 1.

The second pattern is a formed-beam selective-diversity pattern. If a dual-radio structure is used, it is a formed-beam combining-diversity pattern. The second pattern is to use the first antenna 12 as well as the third antenna 16 on left side of the antenna module or the second antenna 14 as well as the fourth antenna 18 on right side of the antenna module. The switching mode of the second pattern is shown as FIG. 2, switch the first switch 52 to the circuit 2 in FIG. 1 while the third switch 56 and the fourth switch 58 are switched to the circuit 1 in FIG. 1. There is no need to care the second switch 54 because the first switch 52 is switched to the circuit 2 in FIG. 1. Thus the first antenna 12 and the third antenna 16 on left side of the antenna module are used. If user intends to switch to use the second antenna 14 and the fourth antenna 18 on right side of the antenna module, as shown in list of FIG. 2, the difference between this mode of use and the above one is only in that the third switch 56 and the fourth switch 58 are switched to the circuit 2 in FIG. 1.

The third pattern is a formed-beam-time-multiplexing pattern. If a dual-radio structure is used, it is a formed-beam-multiplexing pattern. The third pattern is to use the first antenna 12 as well as the fourth antenna 18 or the second antenna 14 as well as the third antenna 16 on the diagonal of the antenna module. When user intends to use the first antenna 12 and the fourth antenna 18 on the diagonal of the antenna module, refer to list in FIG. 2, switch the first switch 52 to the circuit 2 in FIG. 1 and there is no need to care the second switch 54. While the third switch 56 is switched to the circuit 1 in FIG. 1 and the fourth switch 58 is switched to the circuit 2 in FIG. 1. Thus the present invention switches to the first antenna 12 and the fourth antenna 18 on the diagonal of the antenna module for usage. When user intends to switch to use the second antenna 14 and the third antenna 16 on the other diagonal of the antenna module, as shown in list of FIG. 2, the difference between this mode of use and above one is in that the third switch 56 is switched to the circuit 2 in FIG. 1 and the fourth switch 58 is switched to the circuit 1 in FIG. 1.

While transmitting signal generating from the signal processing unit 70, each mode of use according to the present invention sends the transmitting signal into two antennas through the switches and the power dividing modules. Thus radiating effectiveness is improved by adding gains of two antennas. It results in increasing either directivity or coverage of antenna field pattern. The power divider loss is compensated and then the efficiency of each mode of use of the antenna module is enhanced. Furthermore, signal receiving by the antennas is also sent through the power diving modules and the switches to the signal processing unit 70 for being processed. The switching method of each mode of use is shown as FIG. 2.

Figure 3:
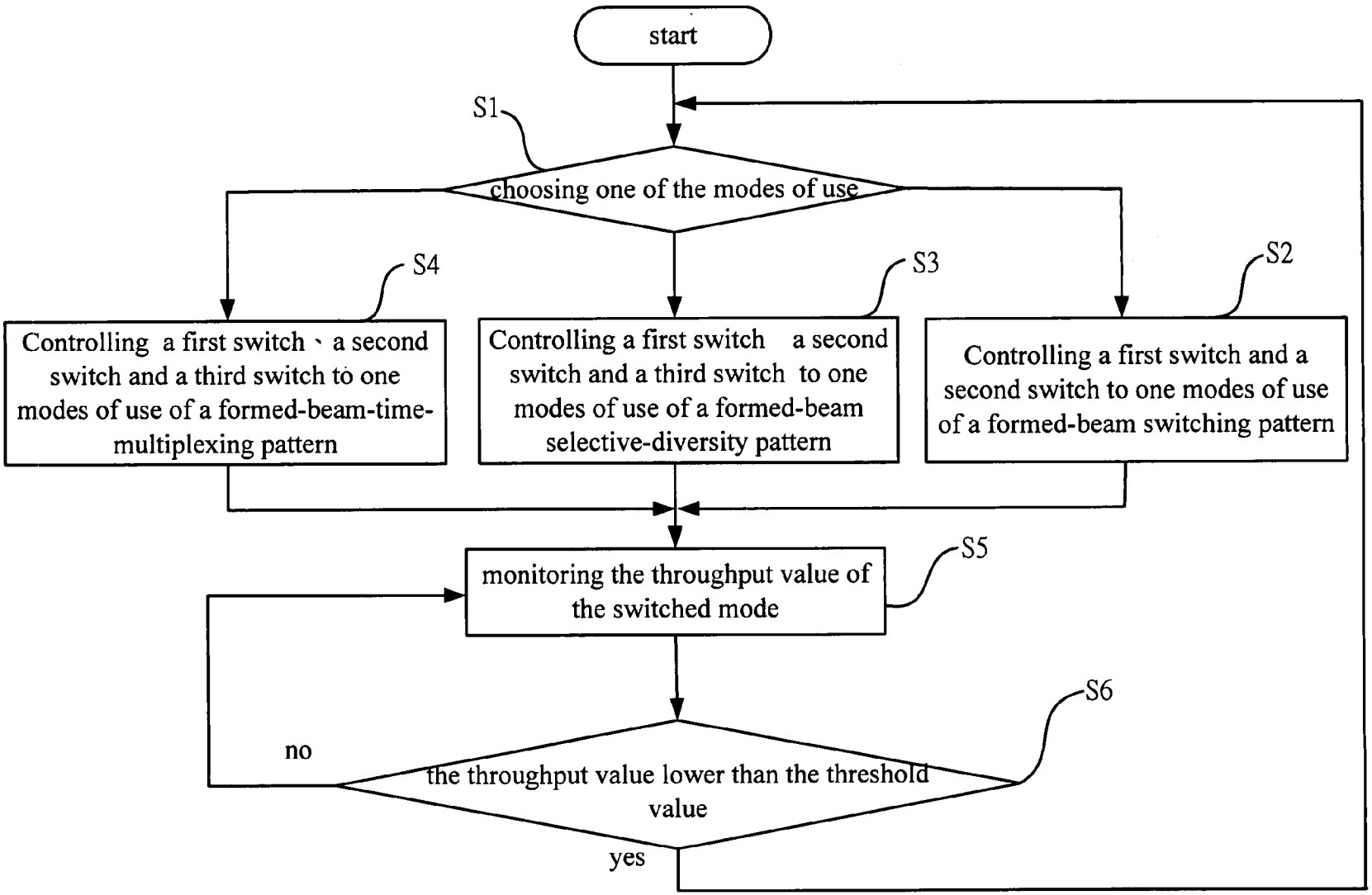
FIG. 3 is a flow chart of an embodiment in accordance with the present invention.

Refer to FIG. 3, a flow chart of a control method according to the present invention is disclosed. First, run the step S1, choose a mode of use of the antenna module. This mode can be preset or selected by the user. Then, switch to the selected mode according to user's choice. For example, when one mode of use of the first pattern is selected—that is one of the a formed-beam switching pattern, take the step S2, switch to use the first antenna 12 and the second antenna by control of the first switch 52 and the second switch 54, so does the third antenna 16 and the fourth antenna 18.

In the same way, in step 1, if the selected pattern is the second one—formed-beam selective-diversity pattern, run the step S3 for switch to one mode of use of the formed-beam selective-diversity pattern. Similarly, if the selected pattern is the third one—a formed-beam-time-multiplexing pattern, take the step S4 so as to switch to that mode of use.

After finishing one of the step S2, S3, or S4 mentioned above, as shown in step S5, monitor the signal throughput of the used mode. At last, run the step S6, compare the throughput value with a threshold value. If the throughput value is lower than the threshold value, take the step S1, choose another mode of use. If the throughput value is higher than or is equal to the threshold value, continue the used mode to run the step S5 and the step S6 in sequence until the throughput value is lower than the threshold value. Then a mode of use is chosen again. Therefore, a proper mode of use is selected so as to improve the efficiency of the antenna module. In the step S6, the comparison is made between average throughput value and the threshold value or the total throughput value and the threshold value.

Figure 4:
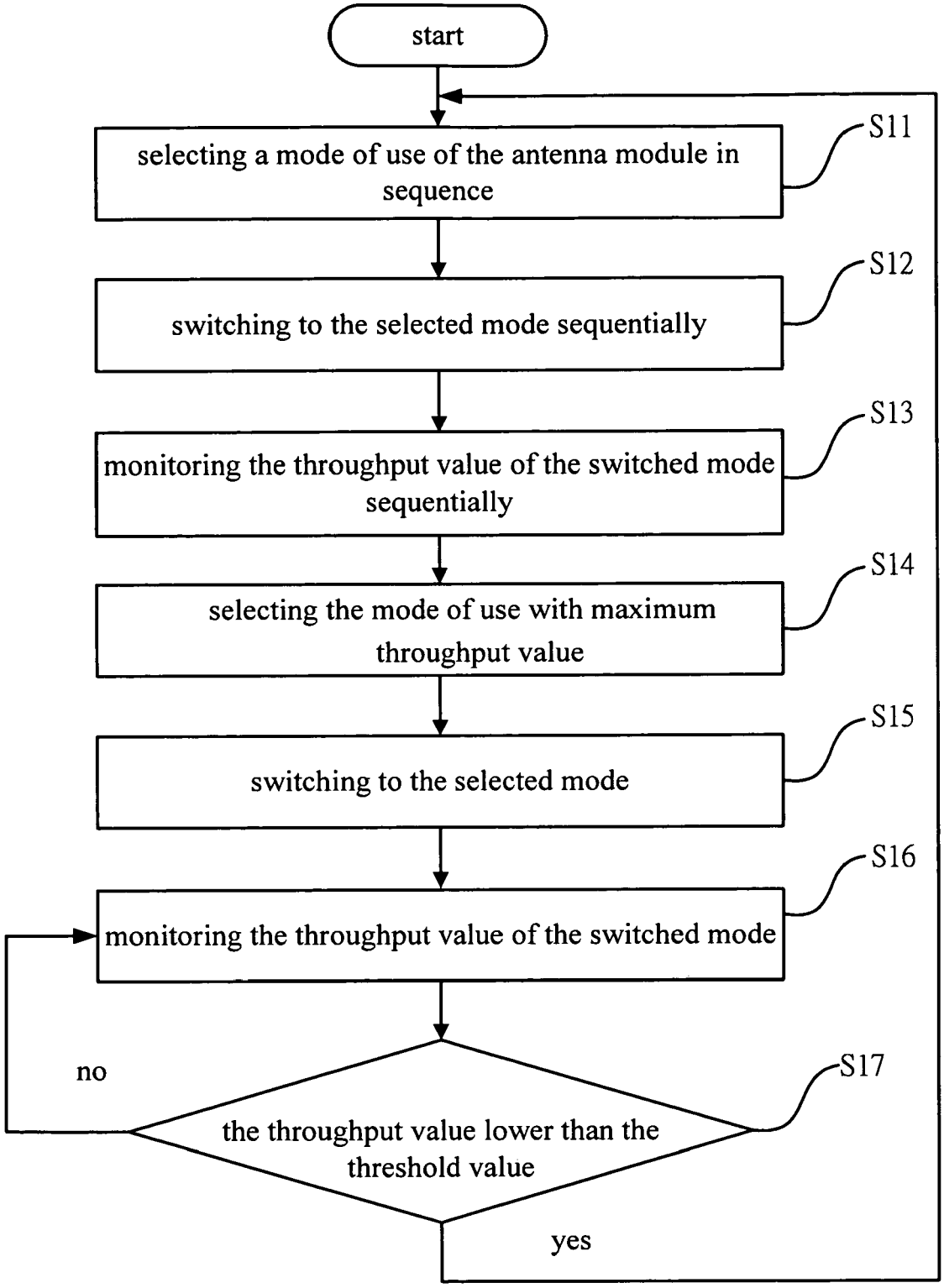
FIG. 4 is a flow chart of another embodiment in accordance with the present invention.

Refer to FIG. 4, a flow chart of another embodiment in accordance with the present invention is disclosed. The difference between this embodiment and above embodiment is in that this embodiment uses step S11, S12, S13 & S14 instead of step S1 of above embodiment. In the beginning, refer to step S11, selecting a mode of use of the antenna module in sequence. As shown in the step S12, switching to the selected mode sequentially. Then take the step S13, the throughput value of the mode of use is monitored sequentially. Finally, run the step S14, choosing the mode of use with maximum throughput value. Thus the mode of use is determined. Refer from step S11 to step S13, select one of the modes of the antenna module. Next, switch to the selected mode. Then monitor the signal throughput of the used mode. Another mode is selected and the above procedures are repeated until all of the modes of the antenna module are selected, switched to use and monitored. Finally, run the step S14, the mode of use with maximum throughput value is selected.

Then run the step S15 and the step S17. The step S15 is the same with the step S2, S3 and S4 of the above embodiment. According to the selected mode in step S14, switch to the selected mode by control of the switches while the step S16 and the step S17 are the same with the above mentioned step S5 and the step S6.

In summary, by the control unit that controls on/off of a plurality of switches, the switching circuit of the antenna module according to the present invention switches the antennas of the antenna module so as to make the antenna module have plurality modes of use. Through on/off of the switches and the power dividing modules, each mode of use divides and sends the transmitting signal generated from the signal processing unit into two antennas for radiating or sends the received signal to the signal processing unit. Each mode uses two antennas so that the gains of antennas are added and the efficiency of the antenna module is enhanced. The control method of the present invention monitors the throughput value of the used mode and compares the throughput value with the threshold value. When the throughput value is lower than the threshold value, another mode is selected. Therefore, a better mode of the antenna nodule is selected and the efficiency of the antenna nodule is improved.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A switching circuit of an antenna module for switching a plurality of antennas of the antenna module so that the antenna module has a plurality of modes of use and each mode with two antennas for radiating a transmitting signal generated from a signal processing unit or sending a received receiving signal to the signal processing unit; the switching circuit comprising:

a plurality of power dividing modules for dividing the transmitting signal into the antennas;

a plurality of switches coupled to the power dividing modules, the plurality of switches including a first switch coupled to the signal processing unit and a second switch coupled to the first switch for sending the transmitting signal to the power dividing modules; and a control unit for controlling on and off of the switches as well as the signal processing unit;

wherein the receiving signal received by the antennas passes through the power dividing modules and the switches, to the signal processing unit, wherein the antenna module has a first antenna, a second antenna, a third antenna and a fourth antenna;

the plurality of power dividing modules comprising:

a first power dividing module dividing the transmitting signal to the first antenna and the second antenna;

a second power dividing module dividing the transmitting signal to the third antenna and the fourth antenna;

a third power dividing module dividing the transmitting signal to the first power dividing module and the second power dividing module; and the plurality of switches including:

the first switch coupled between the signal processing unit and the third power dividing module;

the second switch coupled between the first switch and the first power dividing module as well as between the first switch and the second power dividing module;

a third switch coupled between the third power dividing module and the first power dividing module; and a fourth switch coupled between the third power dividing module and the second power dividing module.

2. The switching circuit as claimed in claim 1, wherein the first power dividing module having:

a first power divider coupled to the second switch;

a second power divider coupled between the first antenna and the first power divider, and also coupled to the third switch;

a third power divider coupled between the second antenna and the first power divider, and also coupled to the third switch;

the second power dividing module having:

a fourth power divider coupled to the second switch;

a fifth power divider coupled between the third antenna and the fourth power divider, and also coupled to the fourth switch;

a sixth power divider coupled between the fourth antenna and the fourth power divider, and also coupled to the fourth switch; and the third power dividing module having:

a seventh power divider coupled to the first switch, the third switch, and the fourth switch.

3. The switching circuit as claimed in claim 2, wherein each of the power dividers is a T-junction splitter.

4. The switching circuit as claimed in claim 2, wherein each of the power dividers is disposed with transformer or impedance matching circuit.

5. The switching circuit as claimed in claim 1, wherein each of the switches is a non-reflective Single Pole Double Throw switch.

6. The switching circuit as claimed in claim 1, wherein the antenna module is arranged in a wireless network device while the plurality of antennas is disposed on two sides of the wireless network device.

7. A switching circuit of an antenna module for switching a plurality of antennas of the antenna module, the antenna module having a plurality of modes of use, in each mode two antennas operating for radiating a transmitting signal generated from a signal processing unit or sending a received receiving signal to the signal processing unit; the switching circuit comprising:

a plurality of power dividing modules for dividing the transmitting signal into the antennas;

a plurality of switches coupled to the signal processing unit and the power dividing modules for sending the transmitting signal to the power dividing modules;

a control unit for controlling on and off switching of the switches and as the signal processing unit;

wherein the receiving signal received by the antennas passes through the power dividing modules and the switches to the signal processing unit;

wherein the antenna module includes a first antenna, a second antenna, a third antenna and a fourth antenna;

wherein the plurality of power dividing modules comprises:

a first power dividing module dividing the transmitting signal to the first antenna and the second antenna;

a second power dividing module dividing the transmitting signal to the third antenna and the fourth antenna;

a third power dividing module dividing the transmitting signal to the first power dividing module and the second power dividing module; and wherein the plurality of switches includes:

a first switch coupled between the signal processing unit and the third power dividing module;

a second switch coupled between the first switch and the first power dividing module as well as between the first switch and the second power dividing module; and a third switch coupled between the third power dividing module and the first power dividing module.

* * * * *